US008378929B2

(12) United States Patent
Kikuta et al.

(10) Patent No.: US 8,378,929 B2
(45) Date of Patent: Feb. 19, 2013

(54) DRIVING METHOD FOR VACUUM FLUORESCENT DISPLAY, AND VACUUM FLUORESCENT DISPLAY

(75) Inventors: Shigeki Kikuta, Mie (JP); Kenji Nakanishi, Mie (JP); Noboru Murata, Mie (JP); Motohisa Isaka, Mie (JP)

(73) Assignees: Noritake Itron Corporation, Mie (JP); Noritake Co., Limited, Aichi (JP)

( * ) Notice: Subject to any disclaimer, the term of this patent is extended or adjusted under 35 U.S.C. 154(b) by 582 days.

(21) Appl. No.: 12/657,843

(22) Filed: Jan. 26, 2010

(65) Prior Publication Data

US 2010/0194788 A1 Aug. 5, 2010

(30) Foreign Application Priority Data

Jan. 30, 2009 (JP) ..... P2009-020275
Feb. 4, 2009 (JP) ..... P2009-023293

(51) Int. Cl.
*G09G 3/22* (2006.01)

(52) U.S. Cl. ..... 345/75.1; 345/47; 345/690; 313/496

(58) Field of Classification Search ..... 345/47, 345/65, 74.1, 75.1, 75.2, 690; 313/496–497; 315/169.1, 169.4
See application file for complete search history.

(56) References Cited

U.S. PATENT DOCUMENTS 4,968,917 A * 11/1990 Harris ..... 315/77
6,005,538 A * 12/1999 Hoekstra ..... 345/47
6,535,184 B1 * 3/2003 Yoon et al. ..... 345/47
8,089,427 B2 * 1/2012 Chou ..... 345/75.1
2004/0207574 A1 * 10/2004 Arai et al. ..... 345/75.1

FOREIGN PATENT DOCUMENTS

JP 11-095712 A 4/1999
JP 2000-250454 A 9/2000
JP 2003-19518 A 7/2003

OTHER PUBLICATIONS

Takao Kishino, Vacuum Fluorescent Displays, p. 155 Sangyo Tosho.

* cited by examiner

*Primary Examiner* — Hong Zhou
(74) *Attorney, Agent, or Firm* — Hedman & Costigan, P.C.; James V. Costigan

(57) ABSTRACT

Luminance life can be enhanced in a vacuum fluorescent display that is driven according to a dynamic drive scheme and that uses a phosphor having remarkable luminance saturation. A drive method for a vacuum fluorescent display, having causing a phosphor layer formed on an anode to display under low-energy electron excitation by the dynamic driving, wherein the phosphor included in the phosphor layer is a phosphor in which the luminance increases when a pulse width is reduced under conditions in which the Du is kept the same in the dynamic driving, and in which, after a voltage is applied to the anode and the luminance of the phosphor is saturated, the time at which the luminance value decreases to 10% of the saturation luminance value following stoppage of the voltage application is 200 μsec or more; and wherein the pulse width and pulse repetition period in the dynamic driving are made variable in the direction of maintaining the initial luminance of the phosphor as driving time elapses.

12 Claims, 15 Drawing Sheets

DRIVING METHOD FOR VACUUM FLUORESCENT DISPLAY, AND VACUUM FLUORESCENT DISPLAY

BACKGROUND OF THE INVENTION

1. Field of the Invention

The present invention relates to a driving method for a vacuum fluorescent display, and to a vacuum fluorescent display in which the driving method is used.

2. Description of the Related Art

Besides ZnO:Zn (green), which has excellent luminescence characteristics, numerous types of phosphors in which $In_2O_3$ or another electrically conductive substance is added to $SrTiO_3$:Pr (red), $CaTiO_3$:Pr (red), $Gd_2O_2S$:Eu (red), $Y_2O_2S$:Eu (red), $La_2O_2S$:Eu (red), $SnO_2$:Eu (orange), ZnS:Mn (orange), $ZnGa_2O_4$ (blue), $ZnGa_2O_4$:Mn (green), or the like have been researched and developed as phosphors for low-energy electron excitation in vacuum fluorescent displays and the like.

However, except for green-luminescent ZnO:Zn, phosphors that have been developed for low-energy electron excitation generally have a short service life.

The dynamic drive method is known as a method for driving a vacuum fluorescent display. In the dynamic drive method, when the duty cycle (hereinafter abbreviated as "Du") is kept constant, the luminance is sometimes lower and sometimes substantially the same due to the variation of the pulse width $t_p$. The Du in this instance is indicated as the ratio ($t_p$/T) of the pulse width $t_p$ and the pulse repetition period T. The luminance is substantially the same in a phosphor having a high response speed, and the luminance decreases in a phosphor having a low response speed. The response speed is indicated as the time at which the phosphor reaches saturation luminance after a voltage is applied to the anode. A phosphor having a low response speed does not reach saturation luminance during voltage application, and therefore has reduced luminance. Dynamic driving using a phosphor with a low response speed is therefore considered to be disadvantageous for obtaining the necessary luminance (Japanese Laid-open Patent Publication No. 2000-250454).

Therefore, when a phosphor having a low response speed is used, the pulse repetition period T is set to 8 to 20 msec to avoid having the pulse repetition period T be shorter than necessary (i.e., to avoid shortening the pulse width). For example, when Du=1/10 to 1/50 and T=10 msec, the pulse width $t_p$ for driving is relatively long, being 200 to 1000 μsec.

The pulse repetition period T is preferably set to 10 msec or less to prevent flickering of the display screen, particularly when the vacuum fluorescent display is subjected to vibration or the like (T. Kishino ed., *Vacuum Fluorescent Displays*, p. 155, Sangyo Tosho).

However, when the pulse width is increased in dynamic driving as described above, display screen flicker and uneven luminance occur, which can lead to reduced display quality.

A method for enhancing the luminance life of the phosphor in dynamic driving is disclosed in Japanese Laid-open Patent Publication No. 2003-195818. An object of this method is to prevent light and dark areas of uneven luminance parallel to the cathode from occurring over time in a vacuum fluorescent display, in particular, a vacuum fluorescent display having a rib grid electrode. In this method, at least one of the pulse width and voltage of the drive pulse applied to at least one of the anode and the grid is adjusted in conjunction with the distance from the cathode to the anode, and the amount that the pulse width and voltage is adjusted in conjunction with the distance from the cathode increases with increased cumulative active time.

A vacuum fluorescent display driving device is also known that comprises driving means for dynamically driving a vacuum fluorescent display by a drive voltage, the drive voltage necessary for driving the vacuum fluorescent display being fed to the driving means; temperature detection means for detecting the temperature of the operating environment of the driving means; and voltage variation means capable of varying the anode voltage fed to an anode of the vacuum fluorescent display and bringing the voltage to the necessary voltage value from the drive voltage according to the result of temperature detection by the temperature detection means (Japanese Laid-open Patent Publication No. 11-95712).

However, various types of phosphors have been developed for low-energy electron excitation, and vacuum fluorescent displays that use these phosphors are in practical use. Most of the phosphors used in these vacuum fluorescent displays have low luminance and short service life even when the method of improvement described above is used, except in the case of the green phosphor ZnO:Zn. There is therefore a need for further increased luminance and service life in a vacuum fluorescent display.

SUMMARY OF THE INVENTION

The present invention was developed in order to overcome such problems as those described above, and an object of the present invention is to provide a driving method capable of enhancing the luminous efficiency and luminance life of a vacuum fluorescent display that uses a phosphor having remarkable continuity of luminance once the luminance is saturated, the vacuum fluorescent display being driven according to a dynamic drive scheme, and to provide a vacuum fluorescent display driven by the driving method.

The drive method of the present invention is a drive method for a vacuum fluorescent display in which a phosphor layer formed on an anode displays under low-energy electron excitation, comprising the step of a dynamic driving, wherein the phosphor included in the phosphor layer is a phosphor in which the luminance increases when a pulse width is reduced under conditions in which a duty cycle is kept the same in the dynamic driving, and in which, after a voltage is applied to the anode and the luminance of the phosphor is saturated, the time at which the luminance value decreases to 10% of the saturation luminance value following stoppage of the voltage application is 200 μsec or more; and wherein the anode voltage, grid voltage, and duty cycle are fixed in the dynamic driving, and driving is performed with the luminance being controlled based on a value of a pulse width or pulse repetition period.

The value of the pulse width or pulse repetition period is such that the pulse width or the pulse repetition period is made variable in the direction of maintaining the luminance of the phosphor, particularly in the direction of maintaining the initial luminance, as driving time elapses. Moreover, the values existing at the time of drive initiation are maintained for the anode voltage, grid voltage, and duty cycle.

In dynamic driving of another embodiment, the pulse repetition period is 7.5 msec or less and the pulse width is 150 μsec or less.

The matrix of the phosphor used in the drive method of the present invention is $Ca_{1-x}Sr_xTiO_3$ (where $0 \leqq x \leqq 1$), $Ln_2O_2S$ (where Ln is Y, La, Gd, or Lu), $Ln_2O_3$ (where Ln is Y, La, Gd, or Lu), $ZnGa_2O_4$, $Zn_2SiO_4$, $Zn_2GeO_4$, $SnO_2$, ZnS, or CaS. The phosphor is also a phosphor having localized luminescence centers.

Moreover, the abovementioned phosphor is a phosphor having luminescence centers that are at least one of transition metal ion luminescence centers and rare earth ion luminescence centers. In particular, the luminescence centers are Mn ions, Pr ions, Eu ions, or Tb ions.

The abovementioned phosphor is at least one phosphor selected from the group consisting of ZnS:Mn, $ZnGa_2O_4$:Mn, $SrTiO_3$:Pr, $CaTiO_3$:Pr, $Gd_2O_2S$:Eu, $Y_2O_2S$:Eu, $ZnGa_2O_4$, $Gd_2O_2S$:Tb, $Y_2O_3$:Eu, $La_2O_2S$:Eu, $SnO_2$:Eu, $Zn_2SiO_4$:Mn, CaS:Mn, and ZnS:Au,Al.

The vacuum fluorescent display of the present invention is a vacuum fluorescent display for injecting a low-energy electron beam into a phosphor layer formed on an anode inside a vacuum vessel, and causing the phosphor layer to emit light by the abovementioned dynamic driving.

In the dynamic drive method of the present invention, the anode voltage, grid voltage, and duty cycle are fixed, and driving is performed according to the value of the pulse width or pulse repetition period in dynamic driving using a phosphor in which the luminance increases when the pulse width is reduced under conditions in which the Du is kept the same, and in which the time at which the luminance value decreases to 10% of the saturation luminance value is 200 μsec or more. Decreases in luminance can therefore be significantly suppressed, and the service life of the vacuum fluorescent display can be increased.

In particular, by setting the pulse repetition period to 7.5 msec or less and the pulse width to 150 μsec or less, the luminous efficiency (luminance) can be significantly increased without changing the Du, i.e., even when power consumption is the same.

The luminance can be increased even when an operation is performed to increase any of the anode voltage, the grid voltage, or the Du as the driving time elapses. However, since such an operation brings about an increase in the number of electrons or the energy of the electrons impinging on the phosphor, degradation of the phosphor is accelerated, and the luminance eventually cannot be compensated. Power consumption also increases. Since the drive method of the present invention enables the luminance to be increased without altering the abovementioned operation conditions, degradation of the phosphor is not accelerated, and there is no increase in the power consumption of the vacuum fluorescent display.

DETAILED DESCRIPTION OF THE INVENTION

Figure 1:
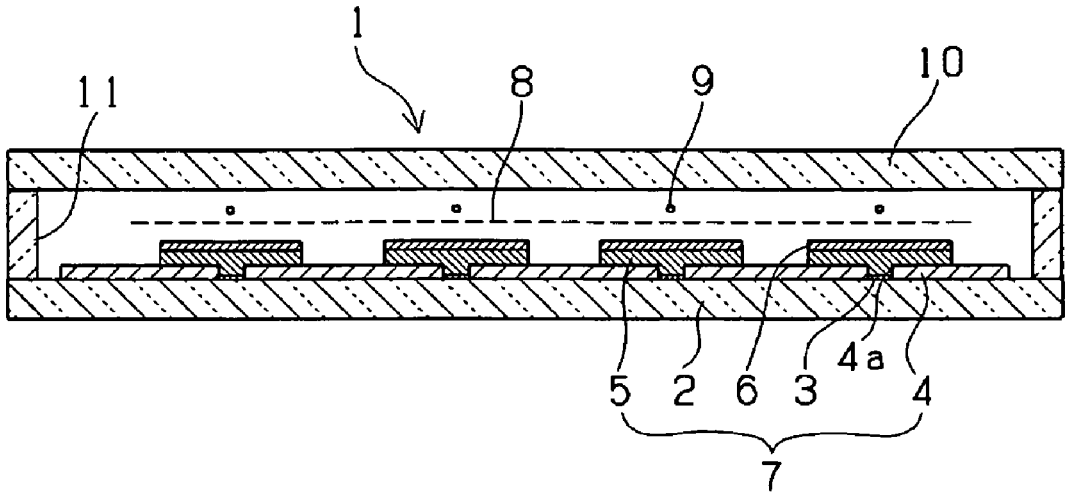
FIG. 1 is a sectional view showing a vacuum fluorescent display.

The drive method of the present invention relates to a dynamic drive method for a vacuum fluorescent display. FIG. 1 is a sectional view showing a vacuum fluorescent display.

The vacuum fluorescent display 1 is provided with phosphor layers 6 formed on each of a plurality of anodes 5 on the display surface of an anode substrate 7. In the display, electrons generated from cathodes 9 positioned above the phosphor layers 6 within the vacuum space are controlled by a plurality of grid electrodes 8 provided between the phosphor layers 6 and the cathodes 9, and the plurality of phosphor layers 6 is caused to emit light in selective fashion.

In FIG. 1, the reference numeral 2 refers to a glass substrate, 3 refers to a wiring layer formed on the glass substrate, 4 refers to an insulation layer, and **4*a* refers to a through-hole for electrically connecting the wiring layer 3 and the anode 5. The reference numeral 10 refers to a face glass, and 11** refers to a spacer glass.

Figure 2:
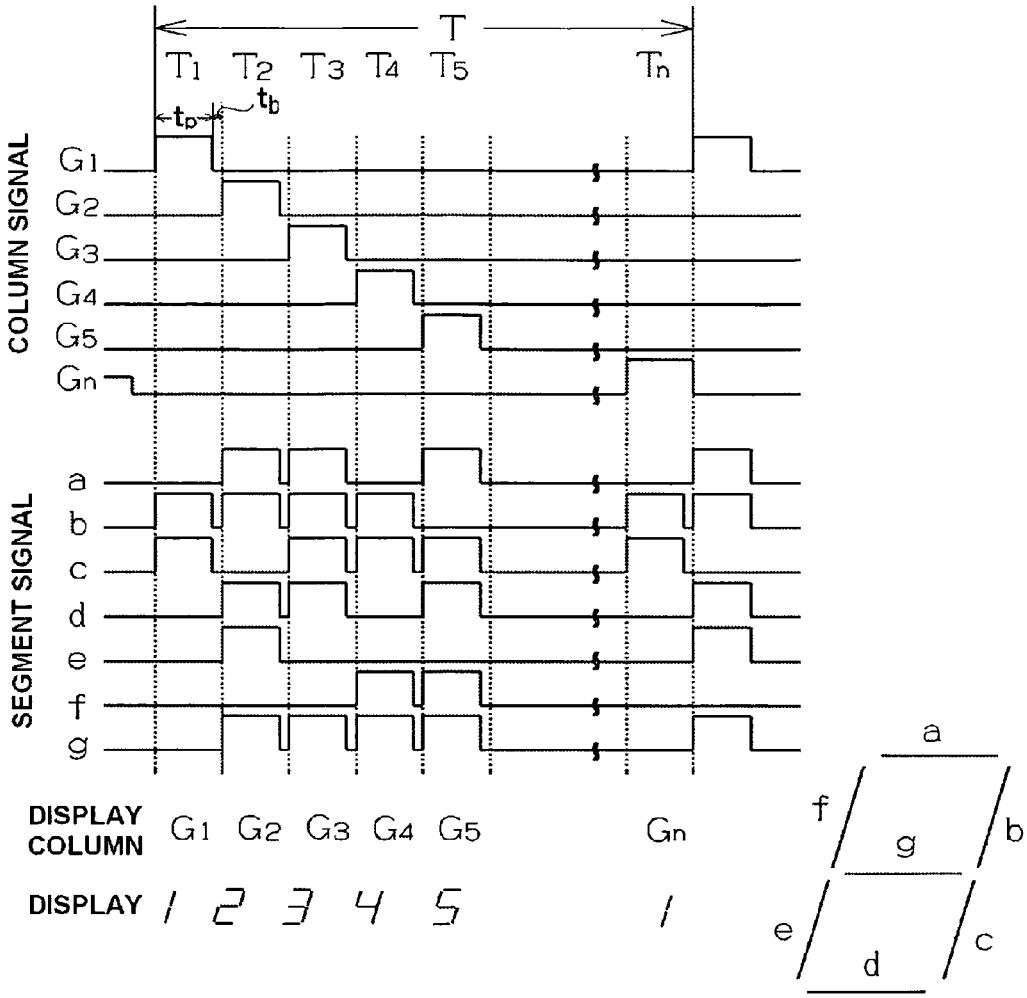
FIG. 2 is a timing chart for the dynamic drive method.

The dynamic drive method will be described using FIG. 2. FIG. 2 is a timing chart for the dynamic drive method.

In the dynamic drive method, an accelerating voltage higher than the potential of the cathodes 9 is sequentially applied and scanned as the pulse voltage of the column signal (grid scan) to the plurality of grid electrodes 8 ($G_1$ through $G_n$). In synchrony with the timing of the scanning, a lighting voltage higher than the potential of the cathodes 9 is selectively applied according to the type of display to a predetermined anode 5 as a pulse voltage of an ON (positive) or OFF (negative) segment signal. FIG. 2 shows Arabic numerals using segments a through g. Through such a dynamic drive method, the grid electrodes 8 are provided so as to be divided for each predetermined luminescence unit (luminescence group). Among the plurality of anodes 5, those anodes 5 that are in predetermined positions for each luminescence unit are each connected by shared anode wiring, the grid electrodes 8 operate as column selection electrodes, and the anodes 5 operate as segment selection electrodes.

In FIG. 2, T is the repetition period composed of periods $T_1$ through $T_n$, $t_p$ is the pulse width, $t_b$ is the blanking time, and Du is defined as the ratio ($t_p$/T) of $t_p$ and T.

Figure 3:
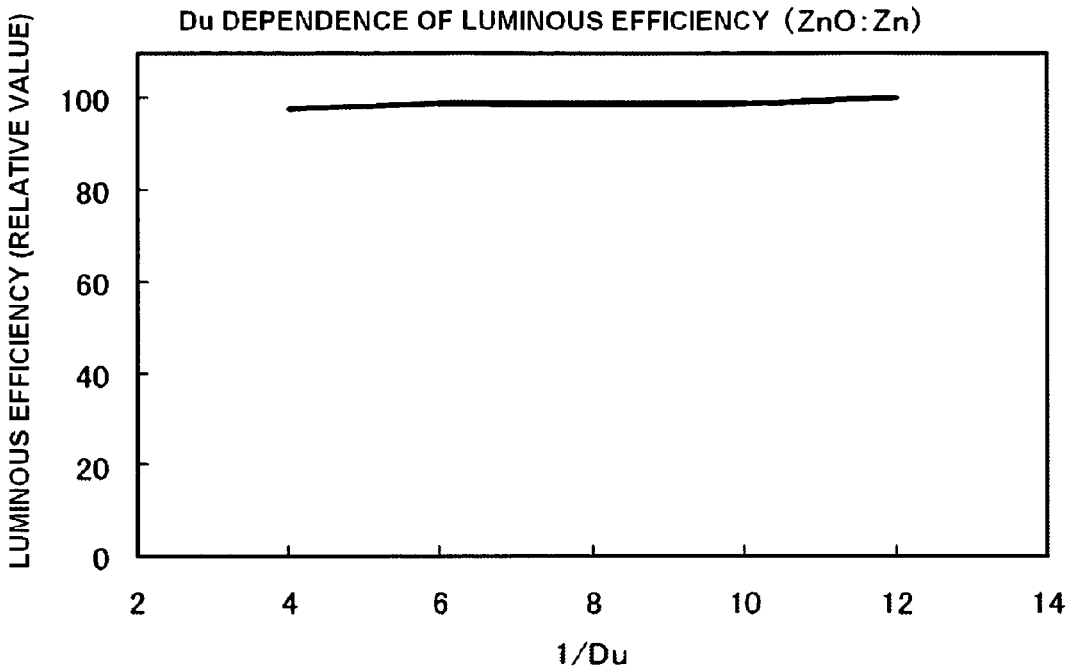
FIG. 3 is a view showing the Du dependence of the luminous efficiency of a ZnO:Zn phosphor.
Figure 4:
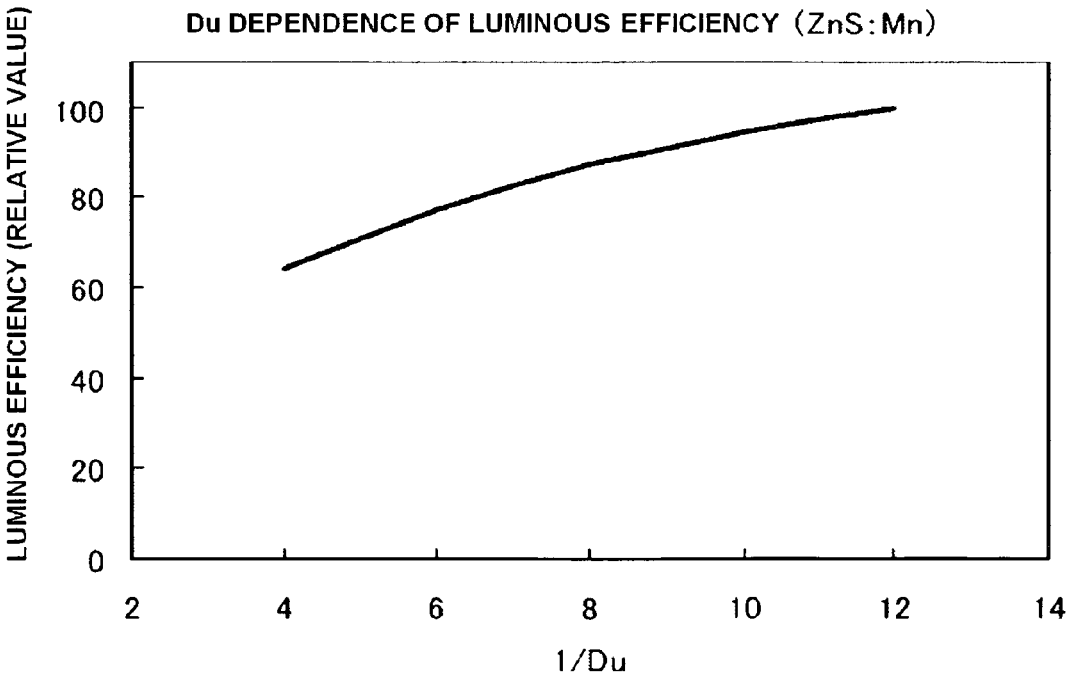
FIG. 4 is a view showing the Du dependence of the luminous efficiency of a ZnS:Mn phosphor.
Figure 5:
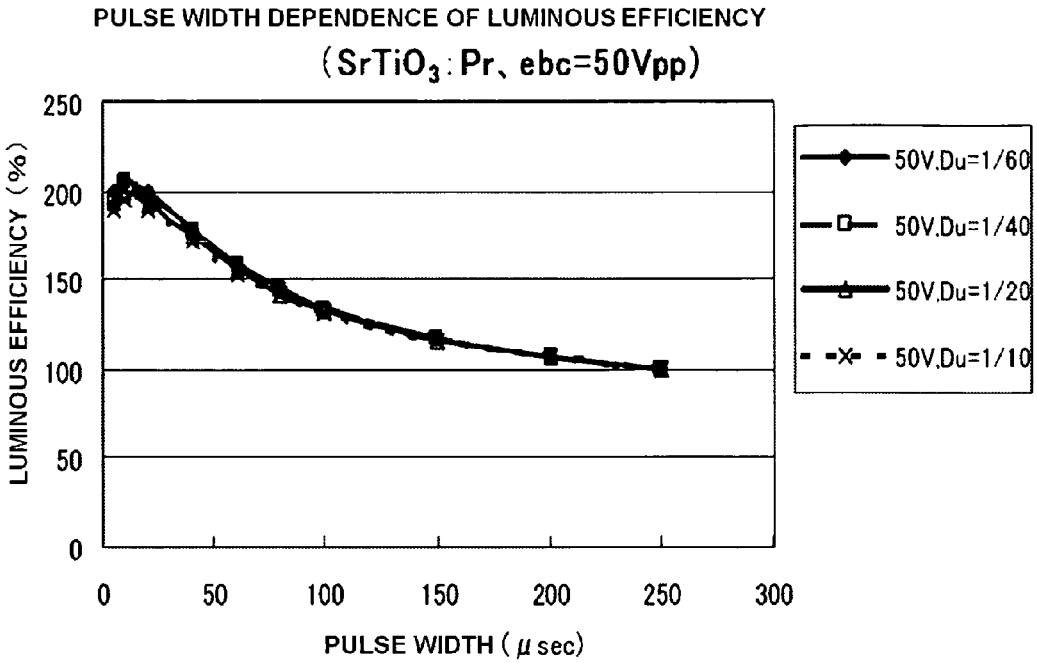
FIG. 5 is a view showing the pulse width dependence of the luminous efficiency of a $SrTiO_3$:Pr phosphor.
Figure 6:
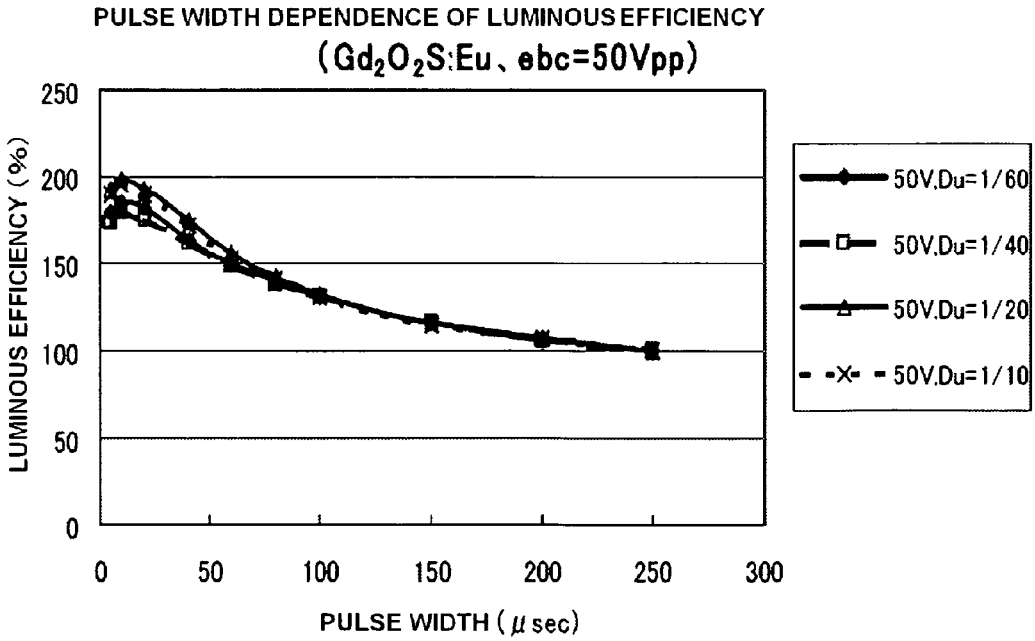
FIG. 6 is a view showing the pulse width dependence of the luminous efficiency of a $Gd_2O_2S$:Eu phosphor.
Figure 7:
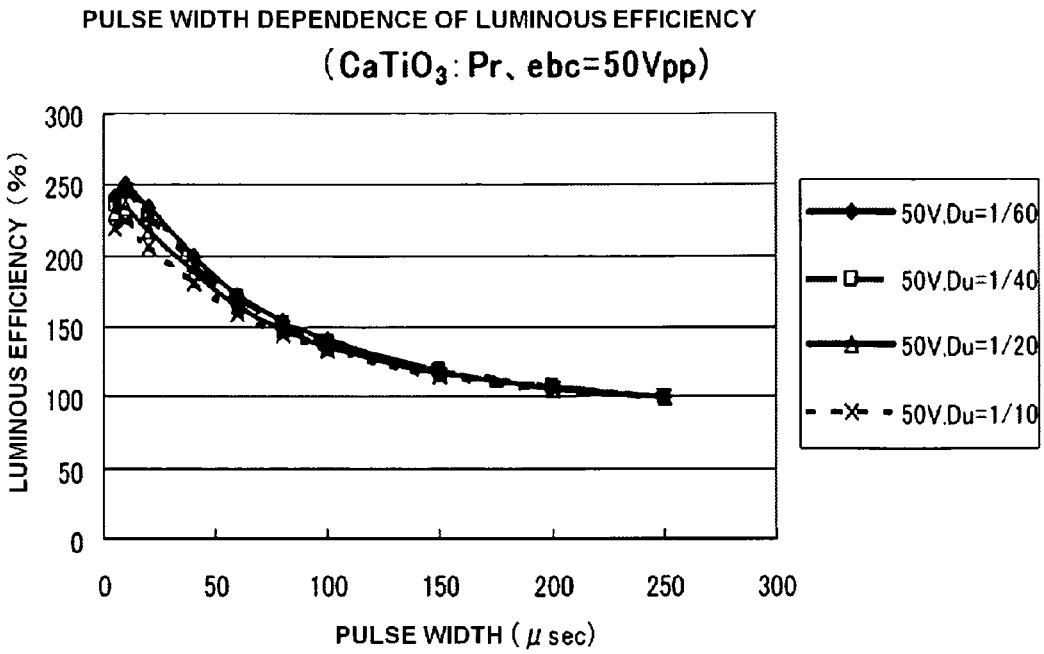
FIG. 7 is a view showing the pulse width dependence of the luminous efficiency of a $CaTiO_3$:Pr phosphor.
Figure 8:
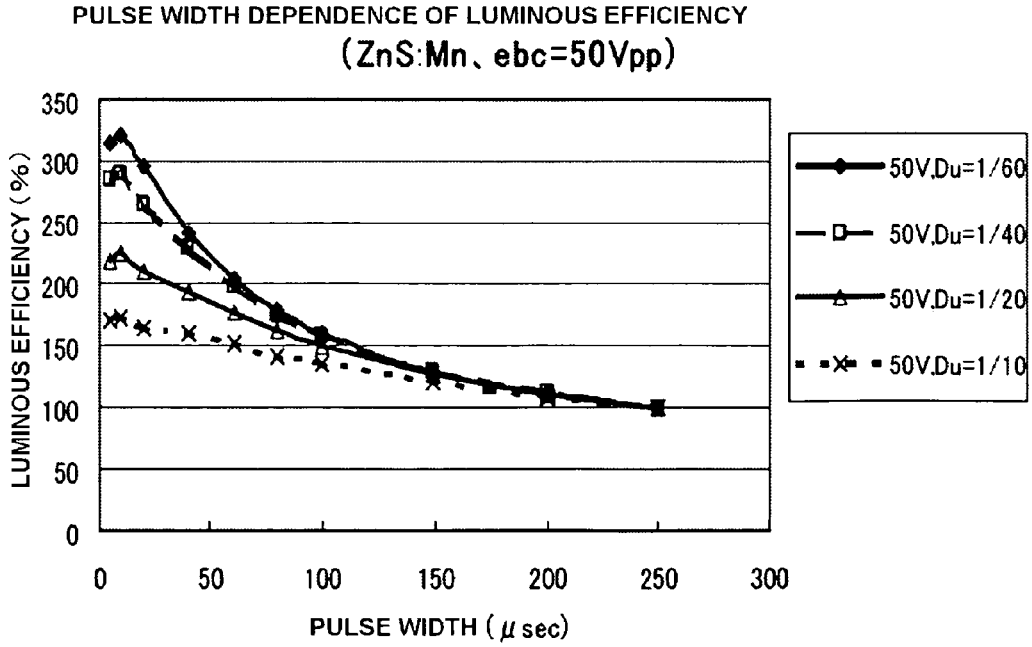
FIG. 8 is a view showing the pulse width dependence of the luminous efficiency of a ZnS:Mn phosphor.
Figure 9:
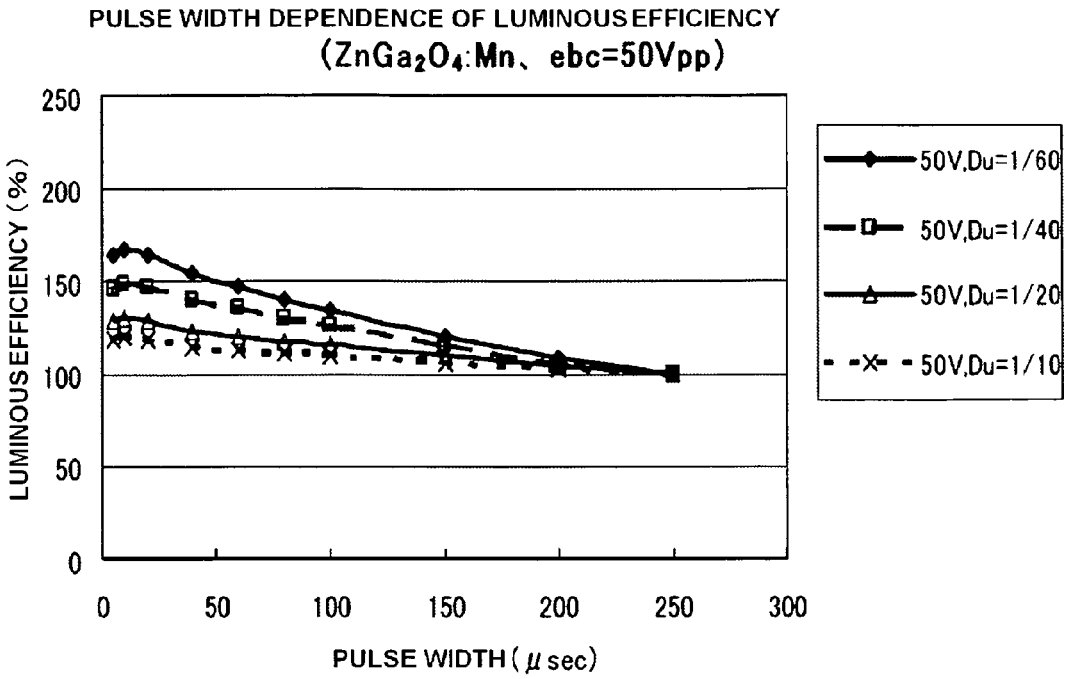
FIG. 9 is a view showing the pulse width dependence of the luminous efficiency of a $ZnGa_2O_4$:Mn phosphor.
Figure 10:
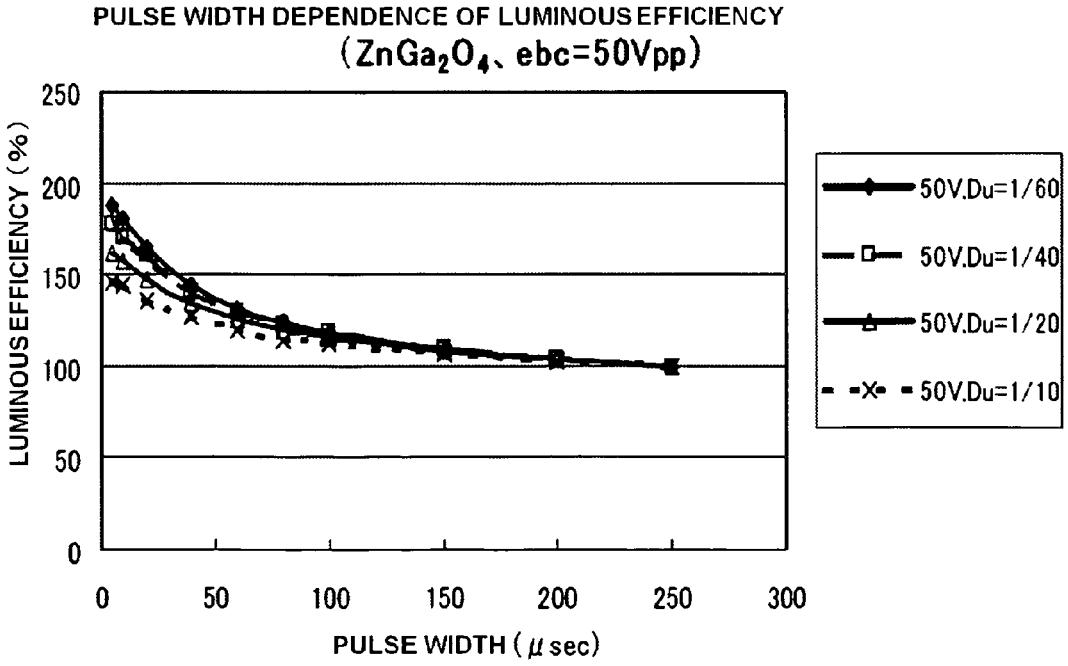
FIG. 10 is a view showing the pulse width dependence of the luminous efficiency of a $ZnGa_2O_4$ phosphor.
Figure 11:
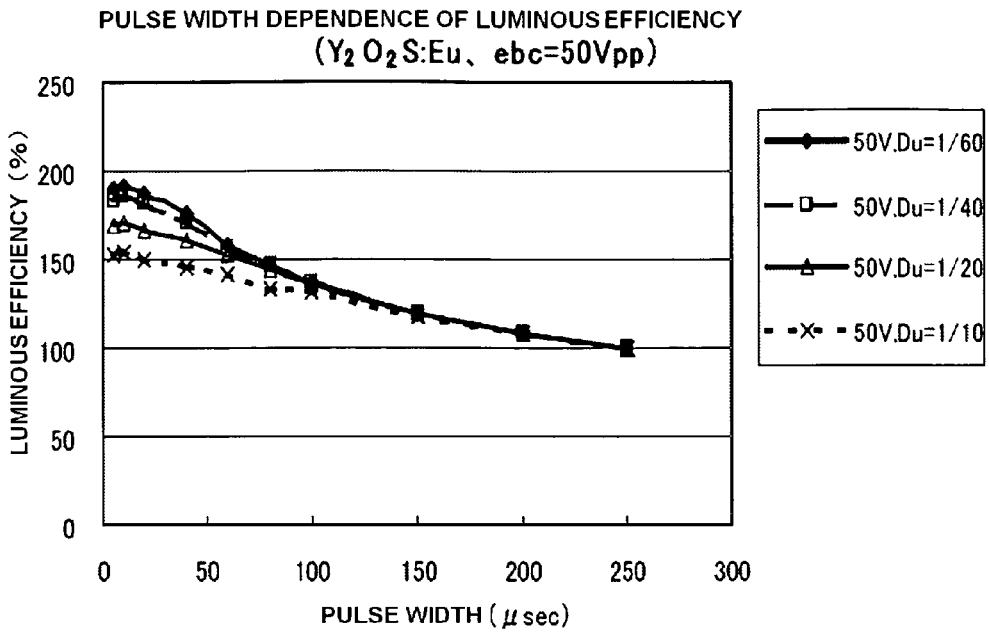
FIG. 11 is a view showing the pulse width dependence of the luminous efficiency of a $Y_2O_2S$:Eu phosphor.

In the dynamic drive method described above, Du dependence varies significantly according to the type of phosphor for low-energy electron excitation. For example, FIG. 3 shows the Du dependence of the luminous efficiency of a ZnO:Zn phosphor, and FIG. 4 shows the Du dependence of the luminous efficiency of a ZnS:Mn phosphor. In the ZnO:Zn phosphor, there is almost no change in luminous efficiency even when the Du varies, i.e., when the current incident on the phosphor is increased or reduced. In contrast, the luminous efficiency significantly decreases in the ZnS:Mn phosphor when the Du increases, i.e., when the current incident on the phosphor is increased.

The ZnS:Mn phosphor has a low response speed and must therefore be driven by a relatively long pulse width of 200 to 1000 μsec in conventional dynamic driving, so that the luminescence thereof rises as much as possible.

However, the present inventors have discovered that the luminance (luminous efficiency) of the ZnS:Mn phosphor and other specific phosphors increases significantly when the pulse width $t_p$ is reduced even when the Du is the same, which is contrary to what had previously been supposed.

In a ZnS:Mn phosphor and other phosphors, the luminance can be significantly enhanced when the pulse width is reduced under predetermined Du conditions. The initial luminance can also be maintained by varying the pulse width as the driving time elapses. The drive voltage can therefore be reduced when the same luminance is obtained, and the service life of the vacuum fluorescent display can therefore be increased. The present invention is based on such facts as these.

FIGS. 5 through 16 show the results of measuring the pulse width dependence of the luminous efficiency. FIGS. 5 through 12 relate to examples of phosphors for which the luminous efficiency is increased when the pulse width $t_p$ is reduced. FIGS. 13 through 16 relate to examples of phosphors for which there is no change in luminous efficiency when the pulse width $t_p$ is varied.

The abovementioned measurements were obtained by the method described below. After various types of phosphors for low-energy electron excitation were applied on a carbon anode of a vacuum fluorescent display, a vacuum tube was produced using a publicly known vacuum fluorescent display manufacturing process. For phosphors other than ZnO:Zn, highly conductive $In_2O_3$ was mixed with the phosphor in a ratio of approximately 10 wt % with respect to the total amount of the phosphor and the $In_2O_3$ in order to prevent charging. The anode/grid electrode (ebc) was set to 50 $V_{pp}$, the Du and pulse width $t_p$ were varied in a state in which the filament cathode was electrically powered and heated to approximately 650° C., and the luminous efficiency characteristics were measured.

The luminous efficiency is a relative value derived from the measured luminance by considering that a luminance value when the pulse width $t_p$ is 250 μsec is 100.

Figure 12:
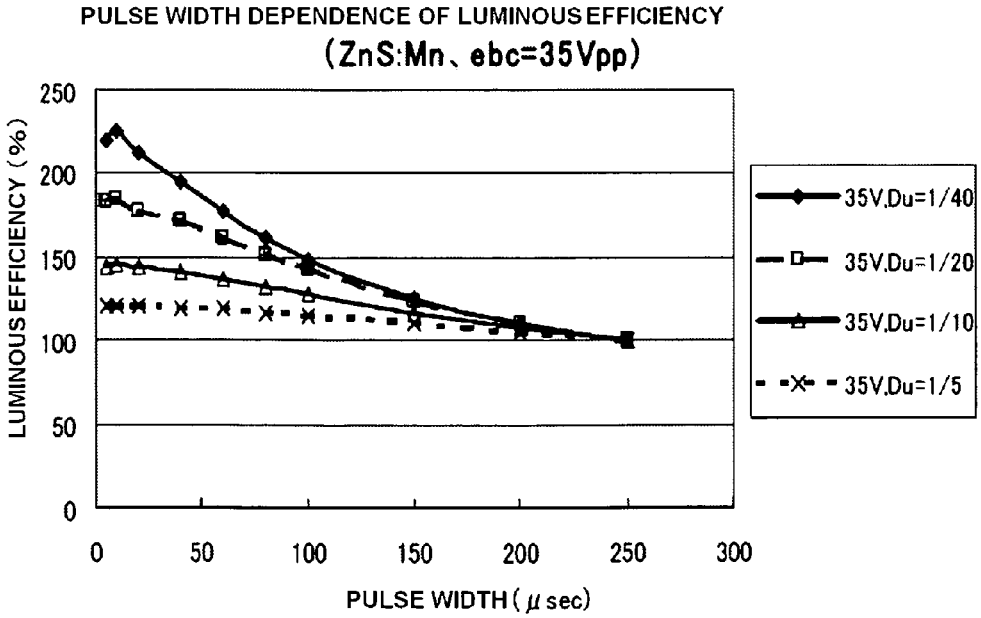
FIG. 12 is a view showing the pulse width dependence of the luminous efficiency of a ZnS:Mn phosphor.
Figure 13:
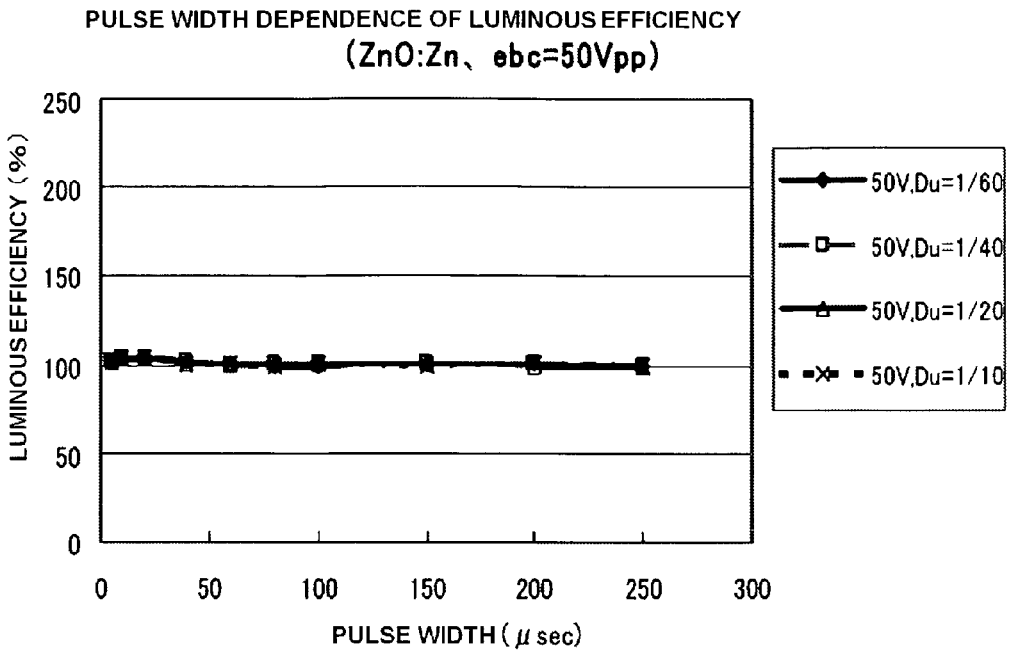
FIG. 13 is a view showing the pulse width dependence of the luminous efficiency of a ZnO:Zn phosphor.
Figure 14:
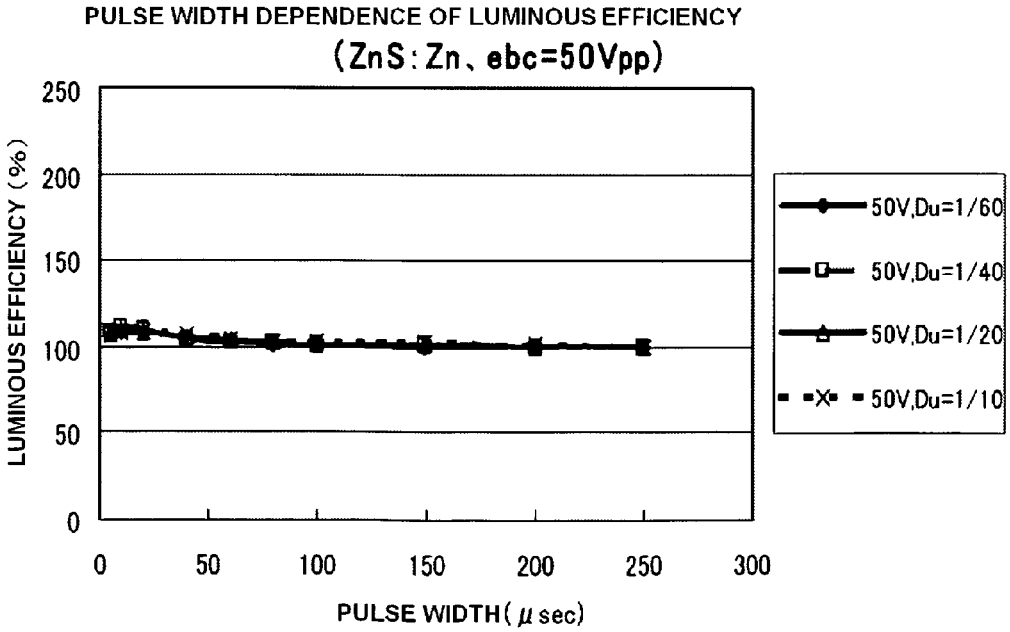
FIG. 14 is a view showing the pulse width dependence of the luminous efficiency of a ZnS:Zn phosphor.
Figure 15:
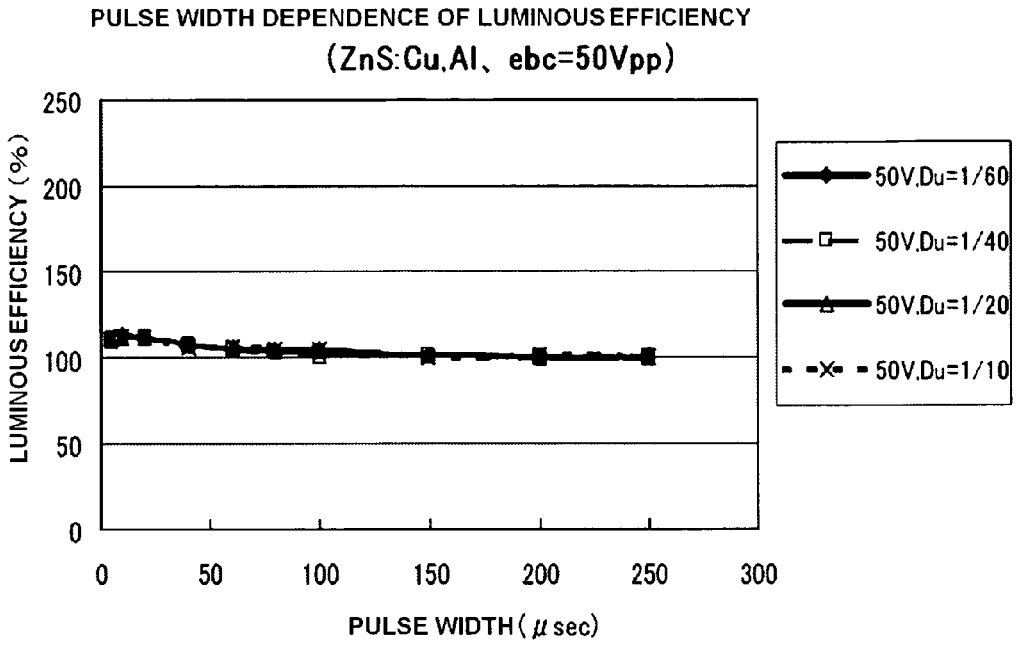
FIG. 15 is a view showing the pulse width dependence of the luminous efficiency of a ZnS:Cu,Al phosphor.
Figure 16:
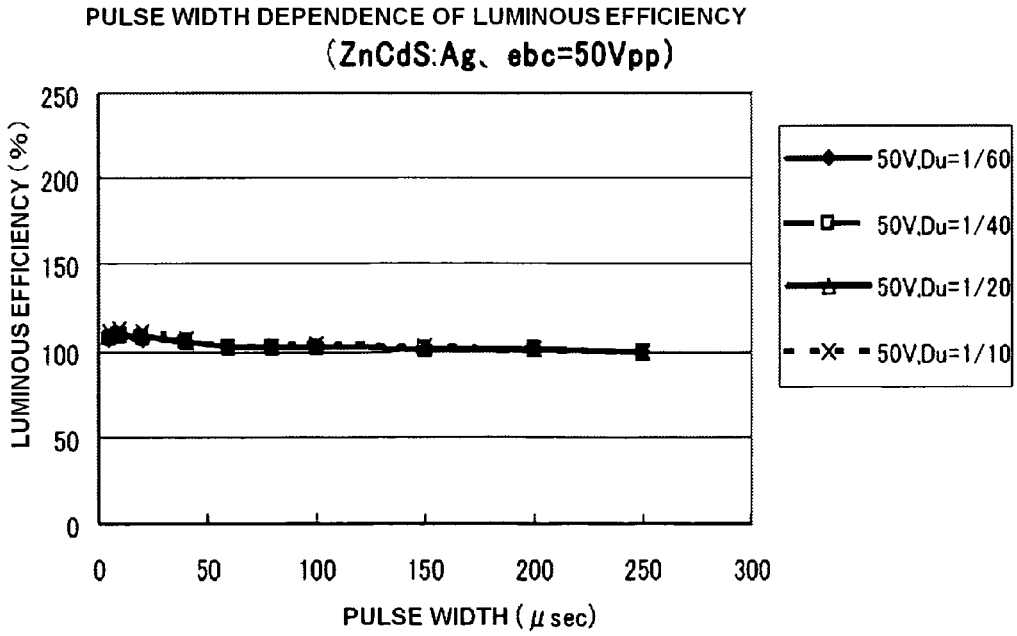
FIG. 16 is a view showing the pulse width dependence of the luminous efficiency of a ZnCdS:Ag phosphor.

As shown in FIGS. 5 through 12, when the phosphor is $SrTiO_3$:Pr (FIG. 5), $Gd_2O_2S$:Eu (FIG. 6), $CaTiO_3$:Pr (FIG. 7), ZnS:Mn (FIG. 8), $ZnGa_2O_4$:Mn (FIG. 9), $ZnGa_2O_4$ (FIG. 10), or $Y_2O_2S$:Eu (FIG. 11), the luminous efficiency is significantly enhanced when the pulse width decreases. FIG. 12 shows ZnS:Mn as an example of a case in which the anode/grid electrode (ebc) is 35 $V_{pp}$. Even when the anode/grid electrode (ebc) is 35 $V_{pp}$, which is lower than 50 $V_{pp}$, the luminous efficiency is significantly enhanced when the pulse width decreases.

As shown in FIGS. 13 through 16, when the phosphor is ZnO:Zn (FIG. 13), ZnS:Zn (FIG. 14), ZnS:Cu,Al (FIG. 15), or ZnCdS:Ag (CdS, 70 wt %) (FIG. 16), the luminous efficiency is not enhanced when the pulse width decreases, and pulse width dependence is not observed. This tendency is the same when the anode/grid electrode (ebc) is 35 $V_{pp}$ as well.

Figure 17:
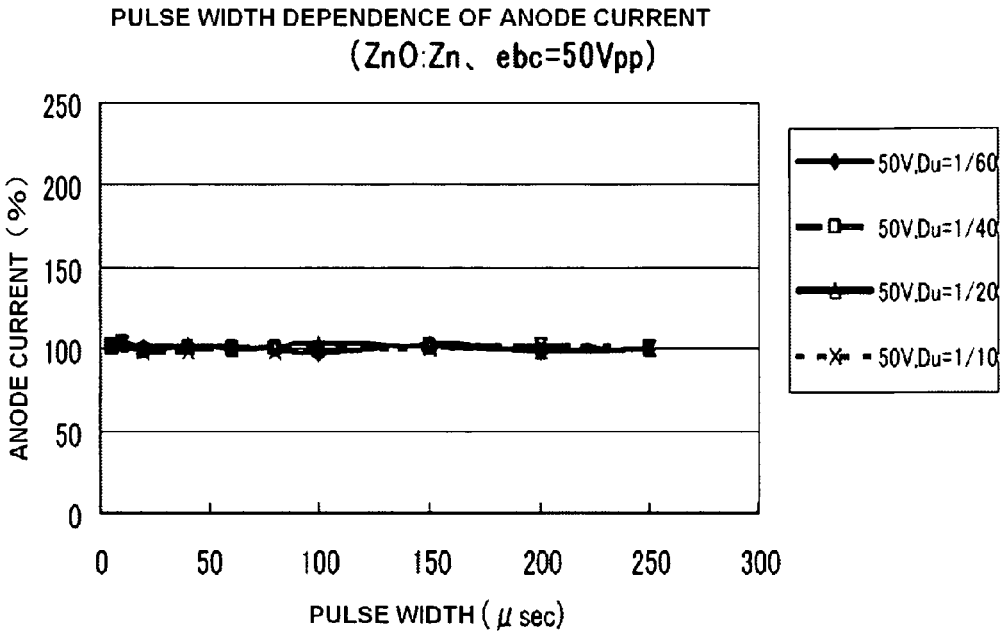
FIG. 17 is a view showing the pulse width dependence of the anode current in a ZnO:Zn phosphor.
Figure 18:
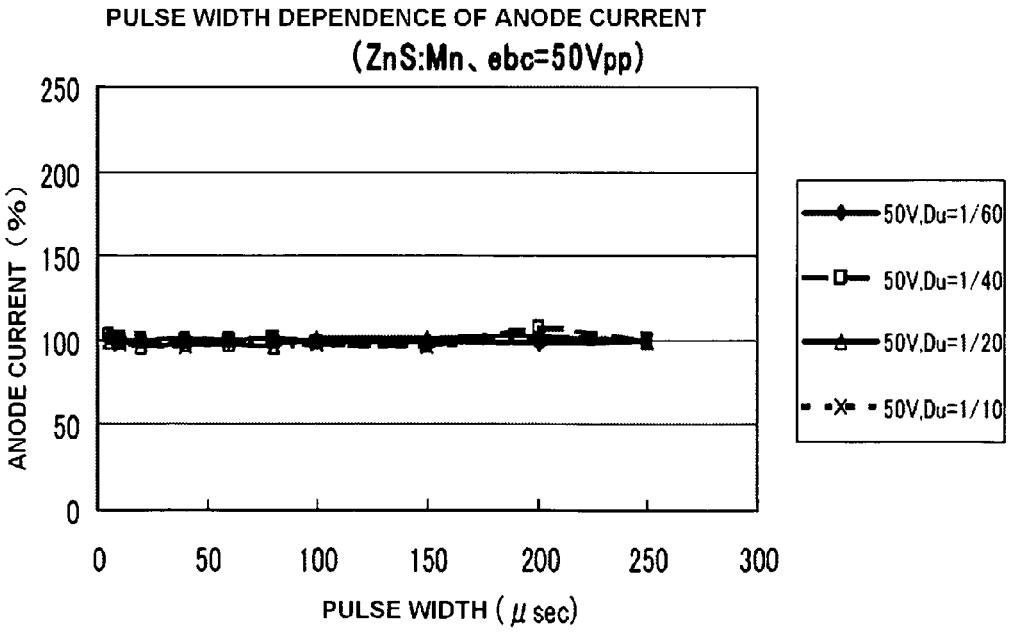
FIG. 18 is a view showing the pulse width dependence of the anode current in a ZnS:Mn phosphor.

In the measurements shown in FIGS. 5 through 16, the pulse width (period) varies, but the anode/grid electrode (ebc) and the Du are each the same. The current (anode current) flowing into the phosphors is therefore substantially constant. Consequently, the dependence of the luminous efficiency is the same as the dependence of the luminance. The pulse width dependence of the anode current in the ZnO:Zn phosphor is shown in FIG. 17, and the pulse width dependence of the anode current in the ZnS:Mn phosphor is shown in FIG. 18, but the anode current is not dependent on the pulse width in either of these cases.

Let us compare phosphors for which the luminous efficiency increases when the pulse width $t_p$ is reduced, and phosphors that do not exhibit pulse width dependence in dynamic driving. The former are phosphors having localized luminescence centers that are at least one of transition metal ion luminescence centers and rare earth ion luminescence centers, and the latter are phosphors having non-localized luminescence centers.

Figure 19:
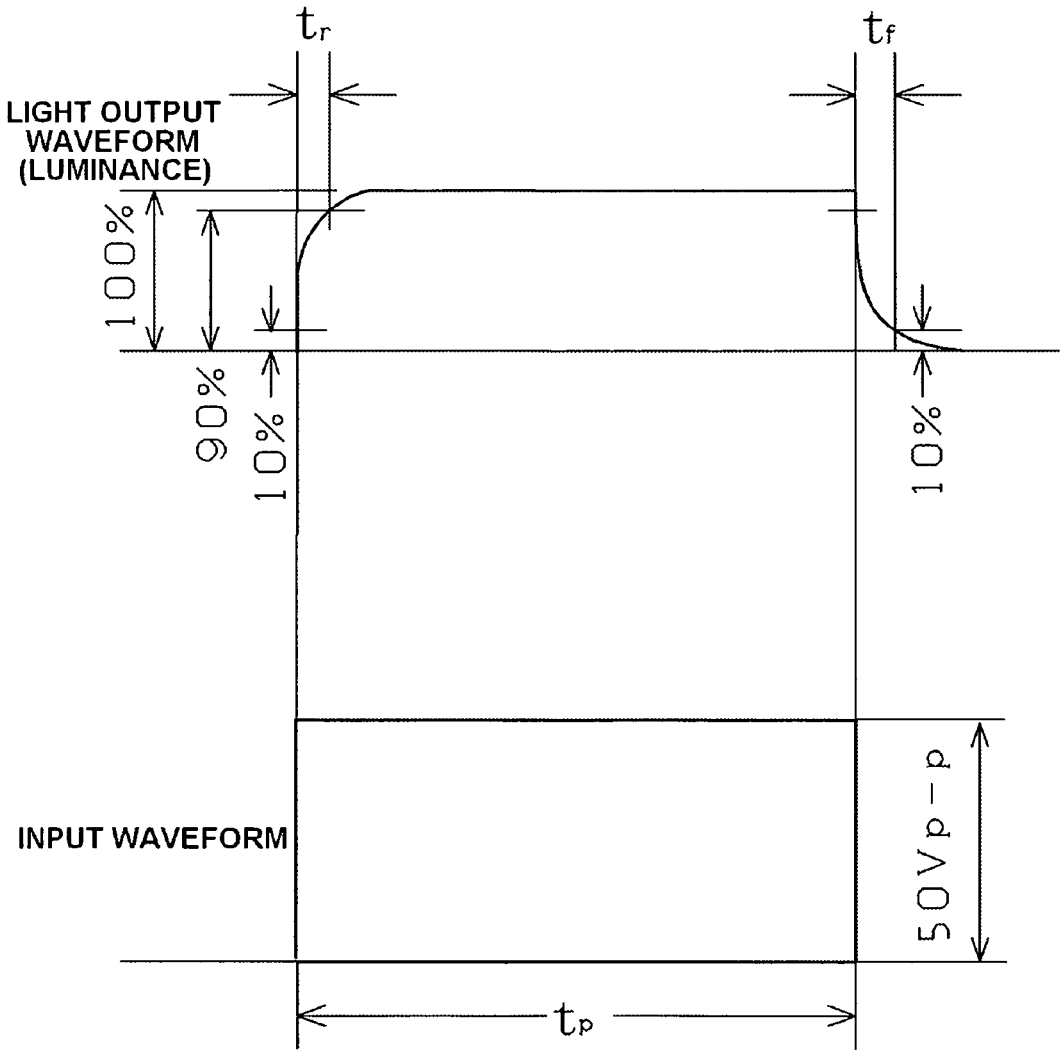
FIG. 19 is a view showing the rise time $t_r$ and fall time $t_f$ of the phosphor luminescence.

Tables 1 and 2 show the results of analyzing the tendency of the saturation luminance value to decrease following stoppage of voltage application after a pulse voltage having the input waveform shown in FIG. 19 is applied to both types of phosphors described above, and the luminance of the phosphors is saturated.

FIG. 19 is a view showing the rise time $t_r$ of the luminescence of the phosphor when the pulse voltage is applied to the anode of the vacuum fluorescent display, and the fall time $t_f$ after voltage application is stopped. In the input waveform, the anode/grid electrode (ebc) is 50 $V_{pp}$, the pulse width $t_p$ is 1 msec, and the time at which the luminance decreases to 10% of the saturation luminance value is measured as the "fall time $t_f$."

TABLE 1

| Phosphor | ZnS:Mn | $SrTiO_3$:Pr | $CaTiO_3$:Pr | $Gd_2O_2S$:Eu | $Y_2O_2S$:Eu | $ZnGa_2O_4$ | $ZnGa_2O_4$:Mn |
|---|---|---|---|---|---|---|---|
| Fall time (μsec) | 1690 | 480 | 360 | 1100 | 1200 | 290 | 5000 |

TABLE 2

| Phosphor | ZnO: Zn | ZnS: Zn | ZnS: Cu, Al | ZnCdS: Ag |
|---|---|---|---|---|
| Fall time (μsec) | 20 | 100 | 100 | 80 |

As shown in Table 2, the fall time for the phosphor group which does not exhibit pulse width dependence is 100 μsec or less, whereas the fall time for the phosphor group for which the luminous efficiency increases when the pulse width $t_p$ is reduced is 290 μsec at minimum, as shown in Table 1.

The phosphor used in the present invention is a phosphor for which the luminance increases when the pulse width is reduced in dynamic driving at the same Du, and for which the fall time exceeds 100 μsec. The fall time of the phosphor used in the present invention is preferably 200 μsec or greater, and more preferably 290 μsec or greater. A phosphor having such characteristics is a phosphor having primarily localized luminescence centers that are at least one of transmission metal ion luminescence centers and rare earth ion luminescence centers. The luminescence centers are preferably Mn ions, Pr ions, Eu ions, or Tb ions.

The matrix of the phosphor is preferably $Ca_{1-x}Sr_xTiO_3$ (where $0 \leqq x \leqq 1$), $Ln_2O_2S$ (where Ln is Y, La, Gd, or Lu), $Ln_2O_3$ (where Ln is Y, La, Gd, or Lu), $ZnGa_2O_4$, $Zn_2SiO_4$, $Zn_2GeO_4$, $SnO_2$, ZnS, or CaS.

Specific examples of the phosphor may include a ZnS:Mn phosphor (orange), $ZnGa_2O_4$:Mn (green), $SrTiO_3$:Pr (red), $CaTiO_3$:Pr (red), $Gd_2O_2S$:Eu (red), $Y_2O_2S$:Eu (red), $Y_2O_3$:Eu (red), $ZnGa_2O_4$ (blue), $La_2O_2S$:Eu (red), $SnO_2$:Eu (orange), $Zn_2SiO_4$:Mn (green), $Gd_2O_2S$:Tb (green), CaS:Mn (orange), ZnS:Au,Al (green), and other phosphors.

In a phosphor that can be used in the present invention, the number of luminescence centers within the electron excitation region is small, or the probability of transition from the excited state to the ground state is low. Therefore, the excitation/luminescence process tends to become saturated and luminance (luminous efficiency) decreases when the pulse width $t_p$ is considerable. Conversely, the luminance (luminous efficiency) is considered to increase correspondingly when the pulse width $t_p$ is small.

The abovementioned phosphor group for which the luminance increases when the pulse width $t_p$ is reduced under conditions in which the Du is the same is used for the dynamic driving of the present invention. Since the luminance increases when the pulse width is reduced, such a phosphor is used, and the pulse width $t_p$ and pulse repetition period T are made variable in the direction of maintaining the initial luminance as driving time elapses.

The luminance of the phosphor often decreases as the driving time elapses. Therefore, specifically, the pulse width $t_p$ and the pulse repetition period T are made less than the $t_p$ and T existing at the time of drive initiation as the driving time elapses.

The $t_p$ and T are reduced while the uniformity of the Du is maintained. Both the anode voltage and the grid voltage are also maintained at the respective values thereof from the time at which driving was initiated.

In order to reduce the $t_p$ and T as the driving time elapses, settings can be made by a publicly known method so that the cumulative drive time is counted and stored in a nonvolatile memory provided in a drive circuit of the vacuum fluorescent display, and the type of phosphor, lighting rate, and other factors are taken into account to cause a controller to vary the pulse width and period after a predetermined time has elapsed, for example.

By adopting these conditions, the dynamic driving of the present invention makes it possible to correct the luminance towards maintaining the initial luminance without increasing the energy or number of electrons impinging on the phosphor and without causing increased power consumption. Furthermore, since the energy or number of electrons does not increase, degradation of the phosphor is not accelerated, and the service life of the vacuum fluorescent display is enhanced. Power consumption is also not increased.

Tables 3 and 4 show the results of measuring the pulse width dependence of the luminous efficiency (luminance) when the anode/grid electrode (ebc) is 50 $V_{pp}$ and the Du is (1/50) for FIGS. 5 through 12 in dynamic driving performed using the abovementioned phosphors with localized luminescence centers. Table 3 shows the phosphors having primarily localized luminescence centers for which the luminous efficiency increases when the pulse width $t_p$ is reduced, and Table 4 shows the phosphors having non-localized luminescence centers for which there is no pulse width dependence.

TABLE 3

Pulse width dependence of luminance-1 (ebc = 50 $V_{pp}$, Du = 1/50)

| Pulse width (μsec) | Period (msec) | $SrTiO_3$:Pr, Al | $Gd_2O_2S$:Eu | $CaTiO_3$:Pr | ZnS:Mn | $ZnGa_2O_4$:Mn | $ZnGa_2O_4$ | ZnS:Au, Al |
|---|---|---|---|---|---|---|---|---|
| 250 | 12.5 | 100 | 100 | 100 | 100 | 100 | 100 | 100 |
| 200 | 10 | 105 | 107 | 108 | 101 | 108 | 104 | 101 |
| 150 | 7.5 | 115 | 116 | 120 | 115 | 119 | 109 | 102 |
| 100 | 5 | 132 | 132 | 141 | 142 | 130 | 119 | 105 |
| 80 | 4 | 140 | 141 | 152 | 157 | 134 | 124 | 106 |
| 60 | 3 | 154 | 152 | 173 | 183 | 140 | 131 | 110 |
| 40 | 2 | 173 | 165 | 195 | 208 | 147 | 43 | 114 |
| 20 | 1 | 198 | 182 | 230 | 247 | 149 | 161 | 124 |
| 10 | 0.5 | 203 | 192 | 244 | 266 | 150 | 179 | 131 |
| 5 | 0.25 | 198 | 190 | 236 | 261 | 145 | 186 | 135 |

TABLE 4

Pulse width dependence of luminance-2 (ebc = 50 $V_{pp}$, Du = 1/50)

| Pulse width (μsec) | Period (msec) | ZnO:Zn | ZnCdS:Ag (Cds 70 wt %) | ZnS:Zn | ZnS:Cu, Al |
|---|---|---|---|---|---|
| 250 | 12.5 | 100 | 100 | 100 | 100 |
| 200 | 10 | 99 | 102 | 99 | 101 |

TABLE 4-continued

Pulse width dependence of luminance-2 (ebc = 50 $V_{pp}$, Du = 1/50)

| Pulse width (μsec) | Period (msec) | ZnO:Zn | ZnCdS:Ag (Cds 70 wt %) | ZnS:Zn | ZnS:Cu, Al |
|---|---|---|---|---|---|
| 150 | 7.5 | 99 | 102 | 101 | 102 |
| 100 | 5 | 100 | 102 | 102 | 102 |
| 80 | 4 | 101 | 103 | 102 | 105 |
| 60 | 3 | 100 | 104 | 103 | 105 |
| 40 | 2 | 101 | 106 | 104 | 107 |
| 20 | 1 | 102 | 108 | 106 | 108 |
| 10 | 0.5 | 106 | 109 | 107 | 109 |
| 5 | 0.25 | 107 | 108 | 107 | 108 |

According to Table 3, the vacuum fluorescent display using the abovementioned phosphor with primarily localized luminescence centers is driven in the dynamic drive method of the present invention with a pulse repetition period T of 7.5 msec or less, preferably 7.0 to 0.5 msec, and a pulse width $t_p$ of 150 μsec or less, preferably 10 to 150 μsec. When the pulse repetition period T exceeds 7.5 msec, and the pulse width $t_p$ exceeds 150 μsec, no enhancement of luminance can be anticipated.

Example 1 and Comparative Example 1

A phosphor in which 10 wt % of $In_2O_3$ was added to ZnS:Mn (orange) was applied on a carbon anode of a vacuum fluorescent display, and a vacuum tube was then produced using a publicly known vacuum fluorescent display manufacturing process. The vacuum fluorescent display thus obtained was lit under conditions of an anode/grid electrode (ebc) of 50 $V_{pp}$ and a Du of 1/60, and the luminance maintenance ratio was measured. The results are shown in FIG. 20.

Using a conventional drive method for Comparative Example 1, the pulse width $t_p$ was fixed at 250 μs, the repetition period T was fixed at 15 msec, and the luminance maintenance ratio of the vacuum fluorescent display was measured.

In Example 1, the pulse width $t_p$ for the time at which lighting was initiated was set to 250 μs, and the repetition period T was set to 15 msec, but as the lighting time elapsed, the Du was maintained at 1/60, and $t_p$ and T were each reduced. The changed values of $t_p$ and T after each elapsed time are shown in Table 5.

Figure 20:
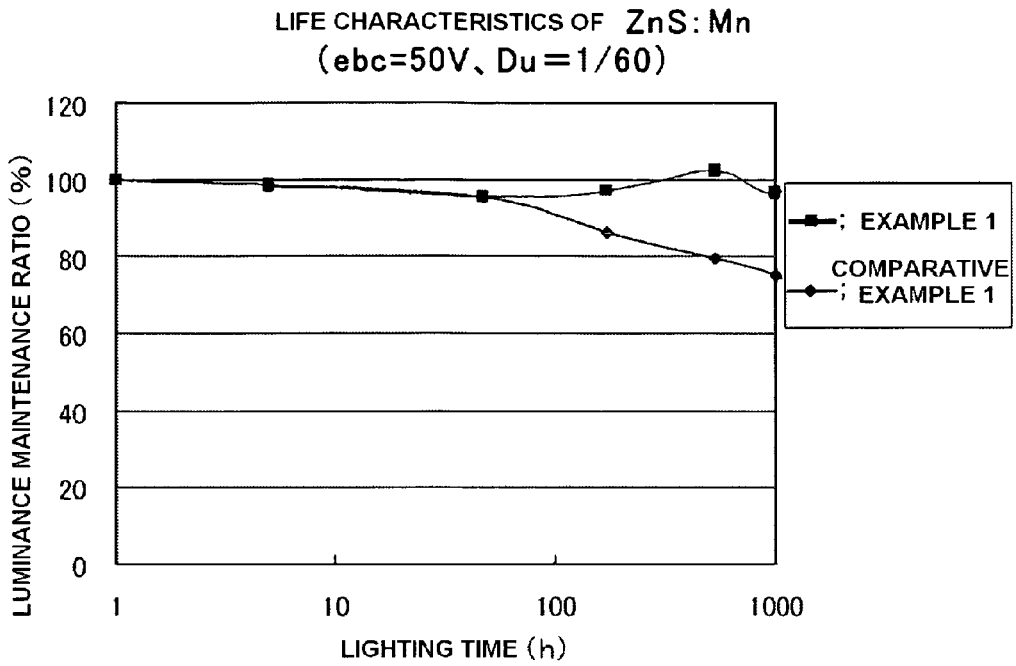
FIG. 20 is a view showing the luminance life of a ZnS:Mn phosphor.

As shown in FIG. 20, the initial luminance decreased significantly in Comparative Example 1, whereas the initial luminance was maintained in Example 1.

Moreover, the luminance maintenance ratio was improved from 87% in Comparative Example 1 to 97% in Example 1 170 hours after the start of lighting, from 79% in Comparative Example 1 to 102% in Example 1 530 hours after the start of lighting, and from 75% in Comparative Example 1 to 95% in Example 1 1000 hours after the start of lighting.

Example 2 and Comparative Example 2

A phosphor in which 10 wt % of $In_2O_3$ was added to $CaTiO_3$:Pr (red) was applied on a carbon anode of a vacuum fluorescent display, and a vacuum tube was then produced using a publicly known vacuum fluorescent display manufacturing process. The vacuum fluorescent display thus obtained was lit under conditions of an anode/grid electrode (ebc) of 50 $V_{pp}$ and a Du of 1/60, and the luminance maintenance ratio was measured. The results are shown in FIG. 21.

Using a conventional drive method for Comparative Example 2, the pulse width $t_p$ was fixed at 250 μs, the repetition period T was fixed at 15 msec, and the luminance maintenance ratio of the vacuum fluorescent display was measured.

In Example 2, the pulse width $t_p$ for the time at which lighting was initiated was set to 250 μs, and the repetition period T was set to 15 msec, but as the lighting time elapsed, the Du was maintained at 1/60, and $t_p$ and T were each reduced. The values of $t_p$ and T after each elapsed time are shown in Table 5.

Figure 21:
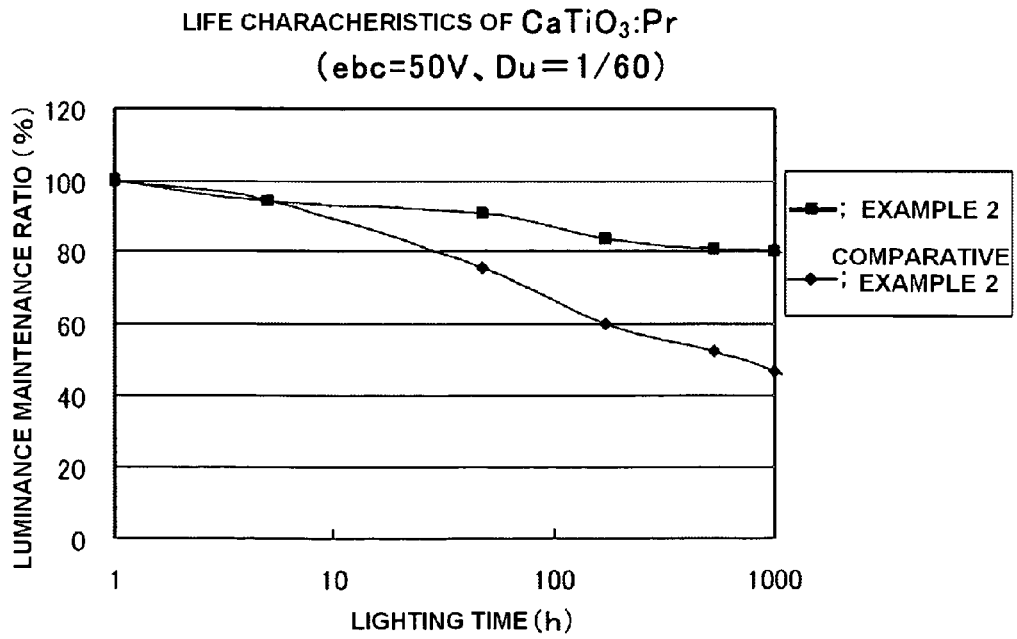
FIG. 21 is a view showing the luminance life of a $CaTiO_3$:Pr phosphor.

As shown in FIG. 21, the initial luminance decreased significantly in Comparative Example 2, whereas there was minimal reduction of the initial luminance in Example 2.

Moreover, the luminance maintenance ratio was improved from 75% in Comparative Example 2 to 91% in Example 2 48 hours after the start of lighting, from 60% in Comparative Example 2 to 84% in Example 2 170 hours after the start of lighting, from 52% in Comparative Example 2 to 80% in Example 2 530 hours after the start of lighting, and from 46% in Comparative Example 2 to 80% in Example 2 1000 hours after the start of lighting.

Example 3 and Comparative Example 3

A phosphor in which 14 wt % of $In_2O_3$ was added to $Gd_2O_2S$:Eu (red) was applied on a carbon anode of a vacuum fluorescent display, and a vacuum tube was then produced using a publicly known vacuum fluorescent display manufacturing process.

The vacuum fluorescent display thus obtained was lit under conditions of an anode/grid electrode (ebc) of 50 $V_{pp}$ and a Du of 1/60, and the luminance maintenance ratio was measured. The results are shown in FIG. 22.

Using a conventional drive method for Comparative Example 3, the pulse width $t_p$ was fixed at 250 μs, the repetition period T was fixed at 15 msec, and the luminance maintenance ratio of the vacuum fluorescent display was measured.

In Example 3, the pulse width $t_p$ for the time at which lighting was initiated was set to 250 μs, and the repetition period T was set to 15 msec, but as the lighting time elapsed, the Du was maintained at 1/60, and $t_p$ and T were each reduced. The values of $t_p$ and T after each elapsed time are shown in Table 5.

Figure 22:
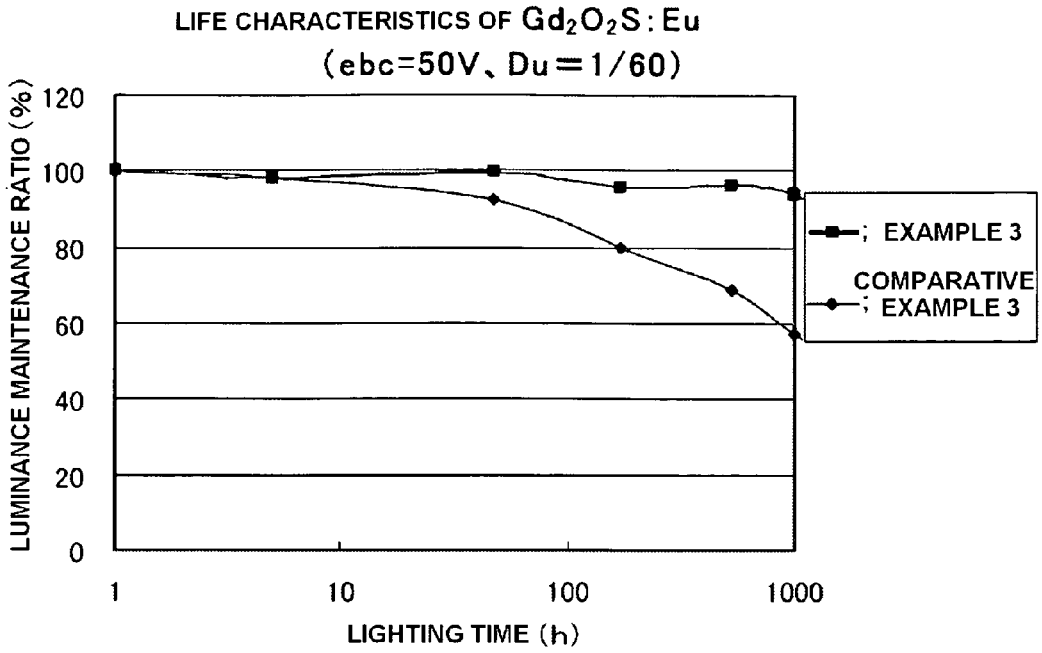
FIG. 22 is a view showing the luminance life of a $Gd_2O_2S$:Eu phosphor.

As shown in FIG. 22, the initial luminance decreased significantly in Comparative Example 3, whereas the initial luminance was maintained in Example 3.

Moreover, the luminance maintenance ratio was improved from 92% in Comparative Example 3 to 100% in Example 3 48 hours after the start of lighting, from 80% in Comparative Example 3 to 96% in Example 3 170 hours after the start of lighting, from 69% in Comparative Example 3 to 96% in Example 3 530 hours after the start of lighting, and from 57% in Comparative Example 3 to 94% in Example 3 1000 hours after the start of lighting.

Example 4 and Comparative Example 4

A phosphor in which 10 wt % of $In_2O_3$ was added to $SrTiO_3$:Pr (red) was applied on a carbon anode of a vacuum fluorescent display, and a vacuum tube was then produced using a publicly known vacuum fluorescent display manufacturing process.

The vacuum fluorescent display thus obtained was lit under conditions of an anode/grid electrode (ebc) of 50 $V_{pp}$ and a Du of 1/60, and the luminance maintenance ratio was measured. The results are shown in FIG. 23.

Using a conventional drive method for Comparative Example 4, the pulse width $t_p$ was fixed at 250 μs, the repetition period T was fixed at 15 msec, and the luminance maintenance ratio of the vacuum fluorescent display was measured.

In Example 4, the pulse width $t_p$ for the time at which lighting was initiated was set to 250 μs, and the repetition period T was set to 15 msec, but as the lighting time elapsed, the Du was maintained at 1/60, and $t_p$ and T were each reduced. The values of $t_p$ and T after each elapsed time are shown in Table 5.

Figure 23:
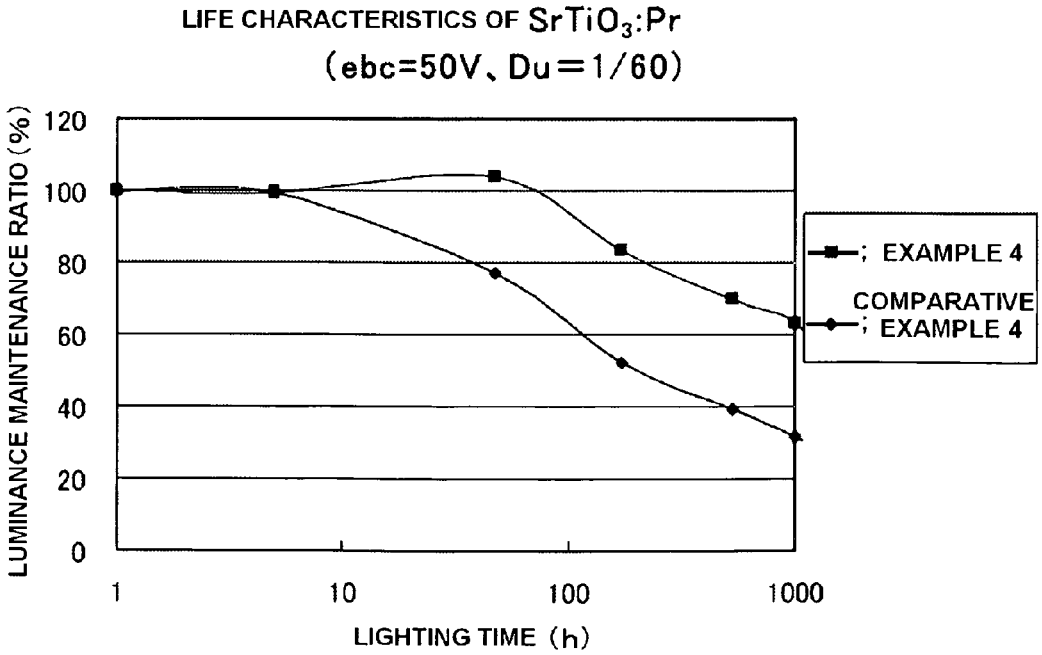
FIG. 23 is a view showing the luminance life of a $SrTiO_3$:Pr phosphor.

As shown in FIG. 23, the initial luminance decreased significantly in Comparative Example 4, whereas there was minimal reduction of the initial luminance in Example 4.

Moreover, the luminance maintenance ratio was improved from 77% in Comparative Example 4 to 104% in Example 4 48 hours after the start of lighting, from 52% in Comparative Example 4 to 83% in Example 4 170 hours after the start of lighting, from 39% in Comparative Example 4 to 70% in Example 4 530 hours after the start of lighting, and from 32% in Comparative Example 4 to 63% in Example 4 1000 hours after the start of lighting.

Example 5 and Comparative Example 5

A phosphor in which 10 wt % of $In_2O_3$ was added to $ZnGa_2O_4$:Mn (green) was applied on a carbon anode of a vacuum fluorescent display, and a vacuum tube was then produced using a publicly known vacuum fluorescent display manufacturing process.

The vacuum fluorescent display thus obtained was lit under conditions of an anode/grid electrode (ebc) of 50 $V_{pp}$ and a Du of 1/60, and the luminance maintenance ratio was measured. The results are shown in FIG. 24.

Using a conventional drive method for Comparative Example 5, the pulse width $t_p$ was fixed at 250 μs, the repetition period T was fixed at 15 msec, and the luminance maintenance ratio of the vacuum fluorescent display was measured.

In Example 5, the pulse width $t_p$ for the time at which lighting was initiated was set to 250 μs, and the repetition period T was set to 15 msec, but as the lighting time elapsed, the Du was maintained at 1/60, and $t_p$ and T were each reduced. The values of $t_p$ and T after each elapsed time are shown in Table 5.

Figure 24:
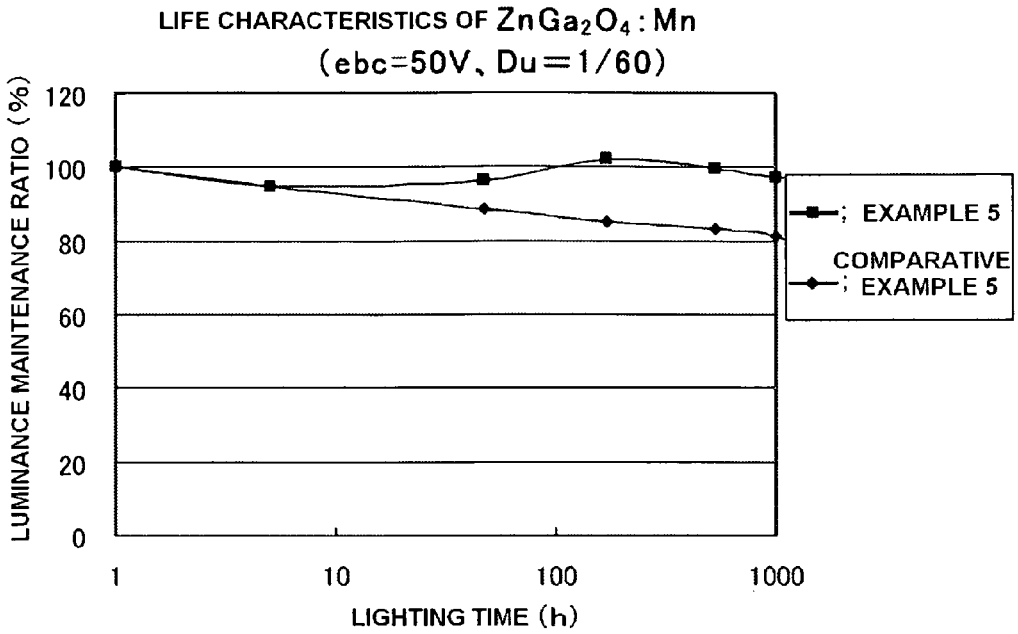
FIG. 24 is a view showing the luminance life of a $ZnGa_2O_4$:Mn phosphor.

As shown in FIG. 24, the initial luminance decreased significantly in Comparative Example 5, whereas the initial luminance was maintained in Example 5.

Moreover, the luminance maintenance ratio was improved from 88% in Comparative Example 5 to 96% in Example 5 48 hours after the start of lighting, from 85% in Comparative Example 5 to 102% in Example 5 170 hours after the start of lighting, and from 72% in Comparative Example 5 to 97% in Example 5 1000 hours after the start of lighting.

TABLE 5

| | Initial value | | After 48 hours | | After 170 hours | | After 530 hours | | After 1000 hours | |
|---|---|---|---|---|---|---|---|---|---|---|
| | $t_p$ (μsec) | T (msec) | $t_p$ (μsec) | T (msec) | $t_p$ (μsec) | T (msec) | $t_p$ (μsec) | T (msec) | $t_p$ (μsec) | T (msec) |
| Example 1 | 250 | 15 | 250 | 15 | 200 | 12 | 150 | 9 | 150 | 9 |
| Example 2 | | | 150 | 9 | 100 | 6 | 80 | 4.8 | 60 | 3.6 |
| Example 3 | | | 200 | 12 | 150 | 9 | 100 | 6 | 40 | 2.4 |
| Example 4 | | | 100 | 6 | 60 | 3.6 | 40 | 2.4 | 20 | 1.2 |
| Example 5 | | | 200 | 12 | 150 | 9 | 150 | 9 | 100 | 6 |
| Comparative Examples 1-5 | 250 | 15 | 250 | 15 | 250 | 15 | 250 | 15 | 250 | 15 |

Example 6 and Comparative Example 6

A $SrTiO_3$:Pr phosphor in which approximately 10 wt % of $In_2O_3$ was mixed was applied on a carbon anode of a vacuum fluorescent display, and a vacuum tube was then produced using a publicly known vacuum fluorescent display manufacturing process.

The vacuum fluorescent display thus obtained was lit by the dynamic drive method. The vacuum fluorescent display was lit under conditions A and B of maintaining the same luminance when the Du was (1/60). In condition A, which was Comparative Example 6 as an example of the prior art, the anode/grid electrode (ebc) was 50 $V_{pp}$, the pulse width $t_p$ was 250 μsec, and the pulse repetition period T was 15 msec. In contrast, in condition B, which was Example 6 of the drive method of the present invention, the anode/grid electrode (ebc) was 40 $V_{pp}$, the pulse width $t_p$ was 80 μsec, and the pulse repetition period T was 4.8 msec.

Figure 25:
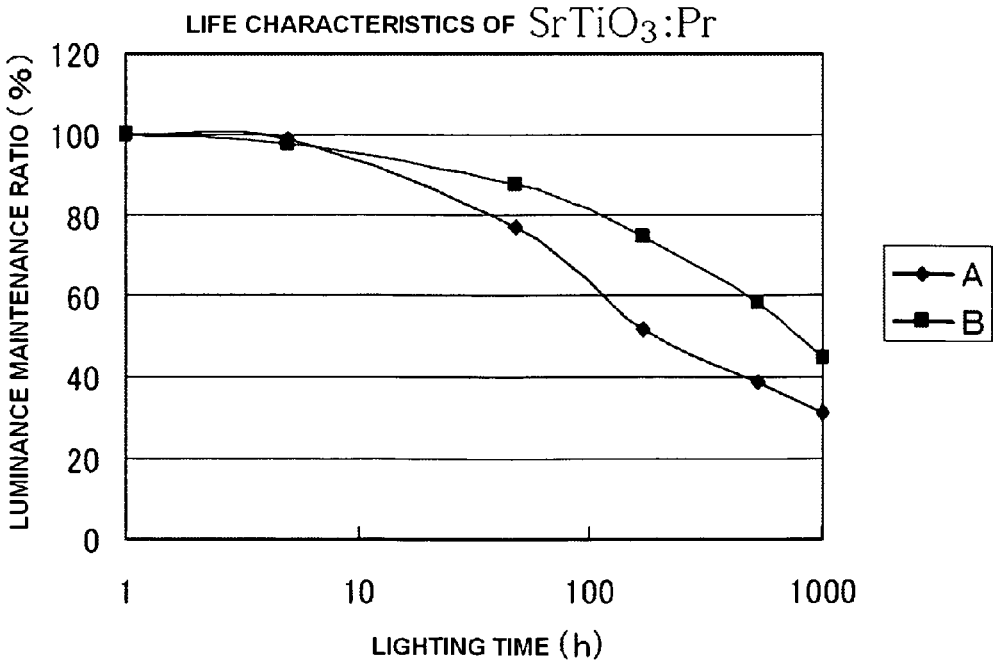
FIG. 25 is a view showing the luminance life of a $SrTiO_3$:Pr phosphor for which the initial luminance is enhanced.

FIG. 25 shows the luminance life achieved when the vacuum fluorescent display was lit under conditions A and B.

In the case of condition B, in which the method of the present invention was used, the anode voltage and anode current could both be kept low. Therefore, the luminance maintenance ratio was enhanced, and the service life of the vacuum fluorescent display was also enhanced relative to the conventional driving condition A.

Example 7 and Comparative Example 7

A $CaTiO_3$:Pr phosphor in which approximately 10 wt % of $In_2O_3$ was mixed was applied on a carbon anode of a vacuum fluorescent display, and a vacuum tube was then produced using a publicly known vacuum fluorescent display manufacturing process.

The vacuum fluorescent display thus obtained was lit by the dynamic drive method. The vacuum fluorescent display was lit under conditions C and D of maintaining the same luminance when the Du was (1/60). In condition C, which was Comparative Example 7 as an example of the prior art, the anode/grid electrode (ebc) was 50 $V_{pp}$, the pulse width $t_p$ was 250 μsec, and the pulse repetition period T was 15 msec. In contrast, in condition D, which was Example 7 of the drive method of the present invention, the anode/grid electrode (ebc) was 35 $V_{pp}$, the pulse width $t_p$ was 40 μsec, and the pulse repetition period T was 2.4 msec.

Figure 26:
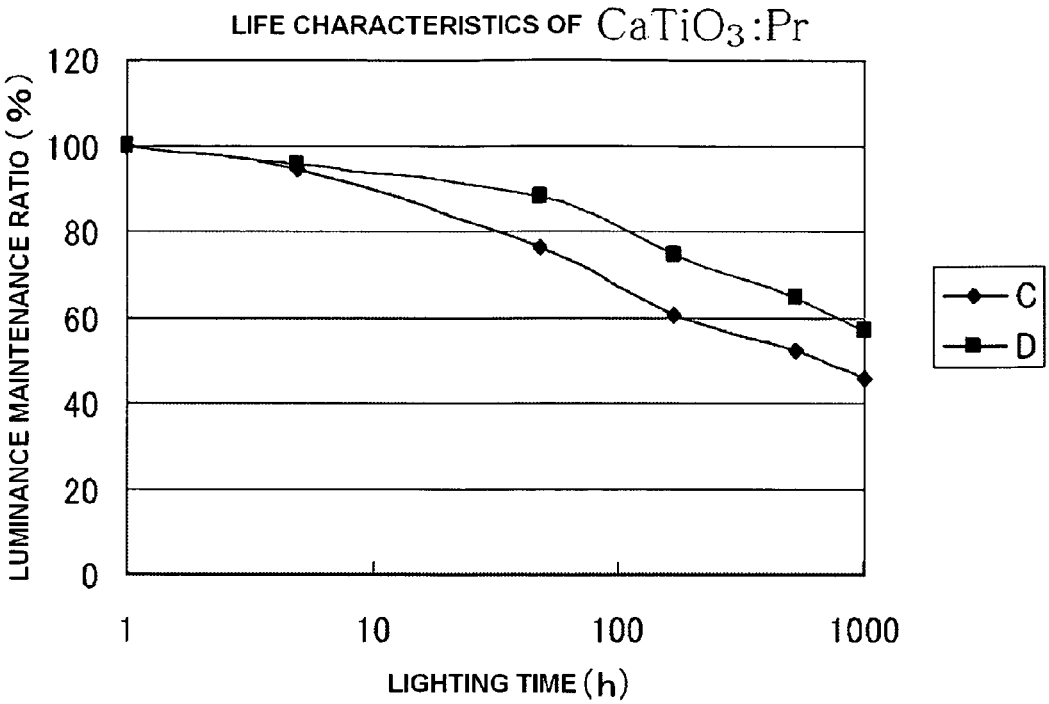
FIG. 26 is a view showing the luminance life of a $CaTiO_3$:Pr phosphor for which the initial luminance is enhanced.

FIG. 26 shows the luminance life achieved when the vacuum fluorescent display was lit under conditions C and D.

In the case of condition D, in which the method of the present invention was used, the anode voltage and anode current could both be kept low. Therefore, the luminance maintenance ratio was enhanced, and the service life of the vacuum fluorescent display was also enhanced relative to condition C.

The drive method of the present invention allows a high-luminance vacuum fluorescent display to be obtained, and enables reduced power consumption and increased service life of the vacuum fluorescent display. The method is therefore suitable for use in a vacuum fluorescent display that uses a phosphor having significant luminance saturation.

What is claimed is:

1. A drive method for a vacuum fluorescent display in which a phosphor layer formed on an anode displays under low-energy electron excitation, comprising the step of a dynamic driving, wherein a phosphor included in said phosphor layer is a phosphor in which a luminance increases when a pulse width is reduced under conditions in which a duty cycle is kept the same in said dynamic driving, and in which, after a voltage is applied to said anode and said luminance of said phosphor is saturated, a time at which a luminance value decreases to 10% of a saturation luminance value following stoppage of a voltage application is 200 μsec or more, wherein an anode voltage, grid voltage, and duty cycle are fixed in said dynamic driving, and driving is performed with said luminance being controlled based on a value of a pulse width or pulse repetition period.

2. The drive method for a vacuum fluorescent display according to claim 1, wherein said value of said pulse width or pulse repetition period is such that said pulse width or said pulse repetition period is made variable in a direction of maintaining said luminance of said phosphor as driving time elapses.

3. The drive method for a vacuum fluorescent display according to claim 2, wherein in maintaining said luminance of said phosphor, an initial luminance is maintained.

4. The drive method for a vacuum fluorescent display according to claim 1, wherein values existing at a time of drive initiation are maintained for said anode voltage, grid voltage, and duty cycle.

5. The drive method for a vacuum fluorescent display according to claim 1, wherein said value of said pulse width or pulse repetition period is set so that said pulse repetition period is 7.5 msec or less, and said pulse width is 150 μsec or less in driving.

6. The drive method for a vacuum fluorescent display according to claim 1, wherein a matrix of said phosphor is $Ca_{1-x}Sr_xTiO_3$ (where $0 \leqq x \leqq 1$), $Ln_2O_2S$ (where Ln is Y, La, Gd, or Lu), $Ln_2O_3$ (where Ln is Y, La, Gd, or Lu), $ZnGa_2O_4$, $Zn_2SiO_4$, $Zn_2GeO_4$, $SnO_2$, ZnS, or CaS.

7. The drive method for a vacuum fluorescent display according to claim 1, wherein said phosphor is a phosphor having localized luminescence centers.

8. The drive method for a vacuum fluorescent display according to claim 1, wherein said phosphor is a phosphor having luminescence centers that are at least one of transition metal ion luminescence centers and rare earth ion luminescence centers.

9. The drive method for a vacuum fluorescent display according to claim 8, wherein said luminescence centers are Mn ions, Pr ions, Eu ions, or Tb ions.

10. The drive method for a vacuum fluorescent display according to claim 1, wherein said phosphor is at least one phosphor selected from the group consisting of ZnS:Mn, $ZnGa_2O_4$:Mn, $SrTiO_3$:Pr, $CaTiO_3$:Pr, $Gd_2O_2S$:Eu, $Y_2O_2S$:Eu, $ZnGa_2O_4$, $Gd_2O_2S$:Tb, $Y_2O_3$:Eu, $La_2O_2S$:Eu, $SnO_2$:Eu, $Zn_2SiO_4$:Mn, CaS:Mn, and ZnS:Au,Al.

11. A vacuum fluorescent display for injecting a low-energy electron beam into a phosphor layer formed on an anode inside a vacuum vessel, and causing said phosphor layer to emit light by dynamic driving, comprising said phosphor layer formed on said anode inside said vacuum vessel, wherein a phosphor included in said phosphor layer is a phosphor in which a luminance increases when a pulse width is reduced under conditions in which a duty cycle is kept the same in said dynamic driving, and in which, after a voltage is applied to said anode and said luminance of said phosphor is saturated, a time at which a luminance value decreases to 10% of a saturation luminance value following stoppage of the voltage application is 200 μsec or more; and wherein said dynamic driving is the drive method according to claim 1.

12. The vacuum fluorescent display according to claim 11, wherein said phosphor is at least one phosphor selected from the group consisting of ZnS:Mn, $ZnGa_2O_4$:Mn, $SrTiO_3$:Pr, $CaTiO_3$:Pr, $Gd_2O_2S$:Eu, $Y_2O_2S$:Eu, $ZnGa_2O_4$, $Gd_2O_2S$:Tb, $Y_2O_3$:Eu, $La_2O_2S$:Eu, $SnO_2$:Eu, $Zn_2SiO_4$:Mn, CaS:Mn, and ZnS:Au,Al.

* * * * *